US005259077A

United States Patent [19]

Hager et al.

[11] Patent Number: 5,259,077

[45] Date of Patent: Nov. 9, 1993

[54] SWIMMING POOL COVER ELEVATION DEVICE

[76] Inventors: Ronald Hager, P.O. Box 504, Clark Fork, Id. 83811; Michael Payne, 303 S. E. 8th, Portland, Oreg. 97214

[21] Appl. No.: 870,557

[22] Filed: Apr. 17, 1992

[51] Int. Cl.[5] ..... E04H 3/19; E04H 15/26

[52] U.S. Cl. ..... 4/498; 135/99; 135/106

[58] Field of Search ..... 4/498, 499, 503; 135/99

[56] References Cited

U.S. PATENT DOCUMENTS

| | | | |
|---|---|---|---|
| 2,825,352 | 3/1958 | Lemen | 4/498 X |
| 3,769,639 | 11/1973 | Bishop | 4/498 |
| 3,801,994 | 4/1974 | Brown . | |
| 4,000,527 | 1/1977 | Gannon . | |
| 4,122,562 | 10/1978 | Sorrentino . | |
| 4,246,663 | 1/1981 | Gragona et al. | 4/500 |
| 4,349,040 | 9/1982 | Miller | 4/503 |
| 4,790,037 | 12/1988 | Phillips . | |
| 4,847,925 | 7/1989 | Perry | 4/498 |
| 4,890,634 | 1/1990 | Dalo et al. | 135/99 |
| 4,951,327 | 8/1990 | Del Gorio, Sr. . | |
| 5,025,513 | 6/1991 | Weissner | 4/498 |

*Primary Examiner*—Daniel M. Yasich

*Attorney, Agent, or Firm*—William A. Birdwell & Associates

[57] ABSTRACT

A swimming pool cover elevation device. A substantially rigid pole is provided with a plurality of ropes attached at one end to the bottom thereof and having hooks disposed at the other end thereof for attachment to structure at or outside the rim of a swimming pool. A cup is provided to be affixed to the underside of the pool cover and to receive the top of the pole. The cup has a concave receptacle and the top of the pole has a convex, rounded end that conforms generally to the shape of the receptacle. Apertures are provided in the cup and the top of the pole for receiving a pin to interconnect the two. The pole has at least two portions that fit slidably together and may be pinned in place to adjust the length of the pole.

20 Claims, 3 Drawing Sheets

SWIMMING POOL COVER ELEVATION DEVICE

BACKGROUND OF THE INVENTION

This invention relates to devices for elevating a swimming pool cover above the rim of the swimming pool, particularly devices for elevating a flexible pool cover above the rim of an above-ground swimming pool that are adapted for ease of installation and removal.

Swimming pool covers are widely used by owners of swimming pools to shield the pools from dirt and other debris during times when the pools are not in use, as well as to discourage persons from entering the pool so as to protect against accidental drowning. However, swimming pool covers that are not elevated above the rim of the pool tend themselves to collect dirt, debris, water, snow and other matter and, accordingly, become difficult to remove without transferring the collected matter to the water in the swimming pool in frustration of the pool cover's purpose. In addition, swimming pool covers that are not elevated pose a risk of accidental drowning if anyone were to fall into water collected on the pool cover.

Conventional pool cover elevation devices and systems generally take one of two forms, each with significant limitations. One form elevates the pool cover by trapping a large volume of air below the pool cover. The air is trapped either by making the cover-to-pool connection air tight or by inserting a balloon, float or other air-trapping device below the surface of the pool cover. Such balloons, floats and air-trapping devices, once inflated, float on the water in the swimming pool, thereby elevating the pool cover above the water surface. In one variation, the air-trapping device elevates a central frame that supports the pool cover, which frame comprises a plurality of arms that are radially-disposed from the top of the air-trapping device and that attach to the rim of the swimming pool. Examples of the foregoing can be found in Brown U.S. Pat. No. 3,801,994, issued Apr. 9, 1974; Gannon U.S. Pat. No. 4,000,527, issued Jan. 4, 1977; Sorrentino U.S. Pat. No. 4,122,562, issued Oct. 31, 1978; and Phillips U.S. Pat. No. 4,790,037, issued Dec. 13, 1988.

This first form of conventional elevation system is subject to significant limitations. For example, over time and particularly during periods of cold weather, the air-trapping device tends to deflate, rendering it ineffective without maintenance. In some systems, the air-trapping device cannot be reinflated without removing the pool cover, which is especially burdensome in adverse weather conditions. In addition, in some cases the air-trapping device is installed by first partially draining and then refilling the swimming pool, a time-consuming and wasteful task. Moreover, such systems tend to be complex; accordingly, installation, maintenance and removal generally cannot be accomplished by hand, without tools and without expending a significant amount of time.

A second form of conventional elevation system relies on a central member from which a plurality of arms radiate in an umbrella-like fashion, instead of relying on a trapped volume of air. In one such system, the central support member is attached to the bottom of the swimming pool and projects vertically from that point of attachment to a position above the swimming pool rim. Each of the plurality of support arms is attached at one end thereof to the top of the central support member and at the other end thereof to the rim of the swimming pool. The pool cover is then supported by the assembly of central support member and support arms. An example of the foregoing can be found in Del Gorio, Sr. U.S. Pat. No. 4,951,327, issued Aug. 28, 1990.

This second form of conventional elevation device or system is also subject to significant limitations. For example, the system of the Del Gorio, Sr. patent generally comprises a large number of substantially rigid components that must be assembled by fixedly interconnecting the components to each other, adjusting their relative positions, and attaching the interconnected assembly both to the bottom of the pool and to the rim of the pool at a plurality of locations. Accordingly, the system's installation, maintenance and removal is relatively difficult and generally cannot be accomplished by hand, without tools and without expending a significant amount of time. Moreover, the central support member makes contact with the bottom of the swimming pool and, therefore, produces a risk of damage to the lining of the swimming pool.

Because the conventional approaches to elevating a pool cover each have inherent limitations, there accordingly is a need for an improved swimming pool cover elevation device.

SUMMARY OF THE INVENTION

The present invention fulfills the aforementioned need by providing a swimming pool cover elevation device that can be installed, maintained and removed by hand, without tools and without spending a significant amount of time. The device makes contact with the swimming pool only at or outside the pool's rim, thereby eliminating the risk to the pool liner associated with contact on the bottom of the pool, it is easily adjustable, and it remains effective independent of the water level within the pool and of temperature changes.

In the invention, the device for elevating a swimming pool cover above the rim of a swimming pool comprises a substantially rigid pole that is suspended from the rim of the swimming pool, at a location inside the rim and in a substantially upright position. The pole is suspended by a plurality of ropes which are, at one end, attached to the bottom of the pole and, at the other end, removably attached to the pool at or outside the rim. The top of the pole is removably attached to the swimming pool cover by a receiving cup that is permanently affixed at a selected position to the underside of the pool cover.

The pole preferably comprises two slidably engaged portions for adjustment of the length of the pole. One portion fits within the other, and each portion includes aligned holes through which a pin may be removably inserted to fix the position of the one portion relative to the other. Thence, the overall length of the pole may be adjusted and fixed, thereby elevating the pool cover to a selected height with respect to the swimming pool rim.

The ropes for suspending the pole are preferably adjustable in length and include hooks by which they may be attached to the pool at or outside the rim thereof. The respective surfaces of the cup and pole that are in contact with one another preferably conform to each other in a manner allowing the pole to pivot when seated in the cup. The cup and the top of the pole include holes placed therein which may be aligned so that a pin can be removably inserted to secure the pole in the cup.

Accordingly, a principal object of the present invention is to provide a novel and improved device for elevating a swimming pool cover above the rim of the swimming pool.

Another object of the present invention is to provide a device for elevating a pool cover that may be installed, maintained and removed by hand, without tools and without expending a significant amount of time.

A further object of the present invention is to provide a device for elevating a pool cover that makes contact with the swimming pool only at or outside the pool's rim, thereby eliminating the risk of damage to the pool liner associated with contact against the interior surface of the pool.

Yet another object of the present invention is to provide a device for elevating a pool cover that is easily adjustable.

Yet a further object of the present invention is to provide a device for elevating a pool cover that remains effective independent of the water level within the pool and of temperature changes.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
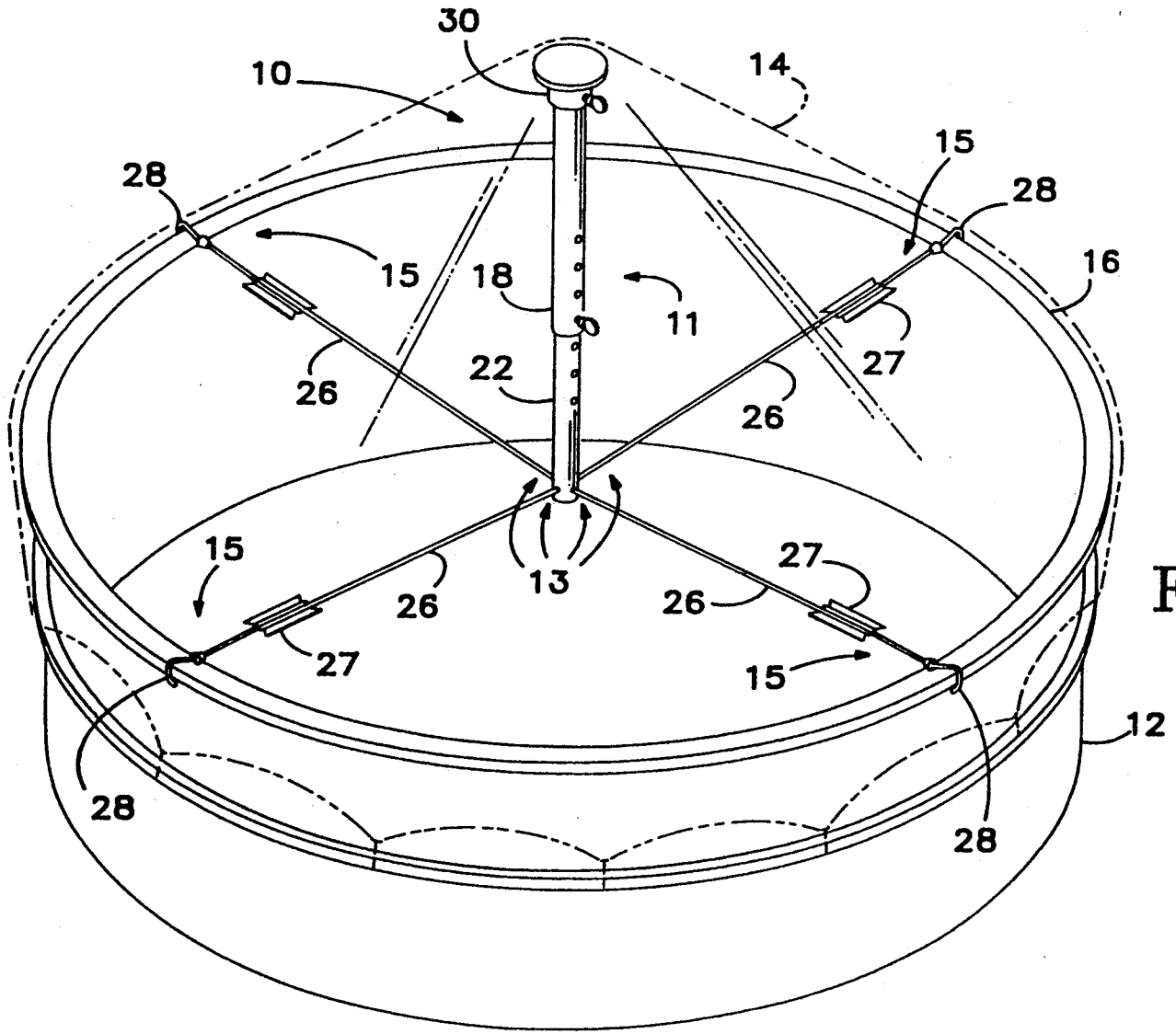
FIG. 1 is a perspective view of a preferred embodiment of a pool cover elevation device in accordance with the present invention installed on an above-ground swimming pool, including a swimming pool cover in hidden lines.

Referring to FIG. 1, a preferred embodiment of the pool cover elevation device 10 in accordance with the present invention is shown installed on an above-ground swimming pool 12 and positioned relative to the swimming pool 12 and a flexible swimming pool cover 14 shown in hidden lines. The device 10 is suspended from the rim 16 of the swimming pool 12 and is positioned under the pool cover 14. Although in the embodiment shown the swimming pool 12 has a rim 16 that is circular in shape, it is to be recognized that the rim 16 may be any shape without affecting the operation of the device 10 or departing from the principles of the invention. Moreover, the swimming pool 12 would generally be filled with water, but it is to be recognized that the operation of the device 10 does not depend on the presence or absence of water in the pool and, accordingly, water is omitted from FIG. 1 and this description.

Figure 2:
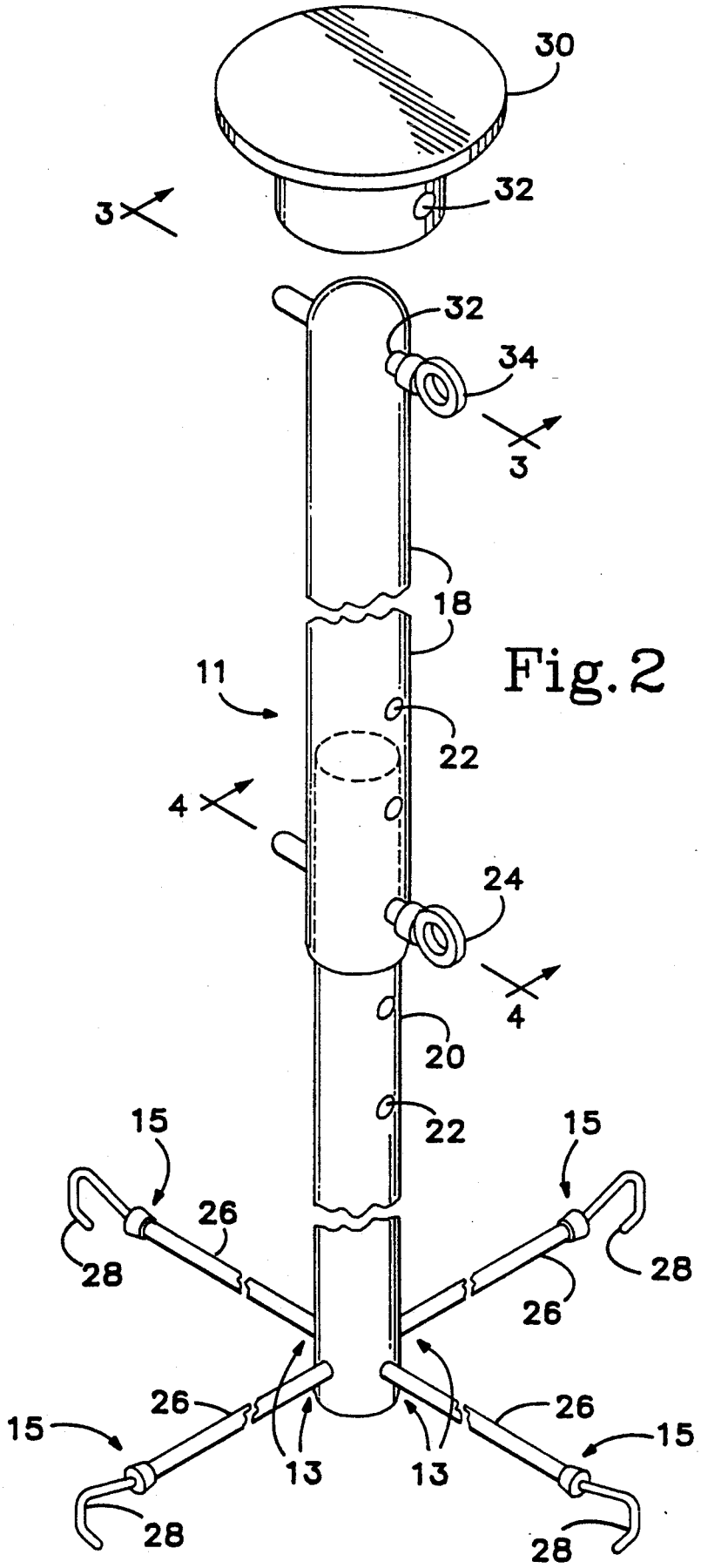
FIG. 2 is a detailed view of the pool cover elevation device of FIG. 1, partially disassembled.
Figure 4:
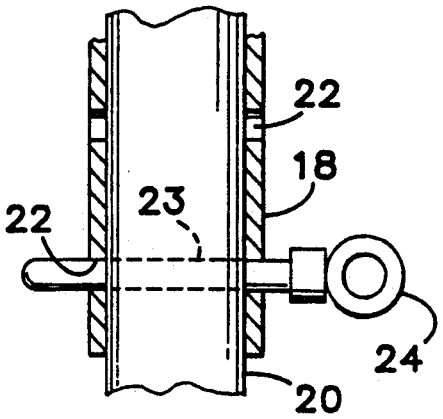
FIG. 4 is a partially cross-sectional, cut-away view of the pool cover elevation device of FIG. 2 taken along line 4—4 thereof.

Referring to FIG. 2, the device 10 employs an elongate, substantially rigid pole 11 having an upper portion 18 and a lower portion 20. The top end of lower portion 20 fits slidably within the bottom end of upper portion 18. Each of the pole portions 18, 20 has adjustment apertures 22 and 23, respectively, that may be aligned by sliding the pole portions 18, 20 to alter their relative longitudinal positions or by rotating the upper portion 18 about its longitudinal axis, or both. Once so aligned, the relative positions of the portions 18, 20 may be fixed by inserting a removable adjustment pin 24 through the portions 18, 20 in aligned adjustment apertures 22, 23, as shown in the cross-sectional view of FIG. 4. By so fixing the relative positions, the overall length of the pole 11 may be adjusted, thereby allowing the device 10 to elevate the pool cover 14 to selective heights with respect to the swimming pool rim 16.

Although in the embodiment shown the overall length of the pole is adjusted by sliding lower portion 20 within upper portion 18, it is to be recognized that different methods for providing a selectable height of elevation may be employed without departing from the principles of the invention. The pole 11 may be made of plastic, wood or some other suitable material, though it should preferably be water-resistant.

The device 10 employs a plurality of ropes 26, each with a near end 13 and a far end 15. The near ends of the ropes 26 are connected to the bottom end of the lower portion 20 by placement in apertures in the lower portion 20. The ropes may be secured in those apertures by, for example, tying knots (not shown) at the ends of the ropes which are disposed inside the lower portion 20. The far ends of the ropes 26 have hooks 28 for removably attaching each of the ropes 26 to the rim 16. By attaching the far end of each of the ropes 26 at selected intervals around the rim 16 of the swimming pool 12, the bottom end of the lower portion 20 is suspended from the rim 16 at a location inside the area enclosed by the rim 16.

Alternatively, ropes 26 on opposite sides of lower portion 20 may actually comprise a single rope which passes into the lower portion 20, is tied in a knot and passes out the other side of the lower portion. Also, two knots may be used instead, one on each side of the lower portion 20 for each rope that passes through the lower portion.

Although in the embodiment shown ropes 26 are used to suspend the pole 11, it is to be recognized that different suspension elements may be employed without departing from the principles of the invention. In addition, it is to be recognized that the ropes 26, or other suspension elements, would preferably be provided with any of a variety of well-known devices for adjusting their length, as, for example, flat members 27 around which a portion of the rope may be wrapped and secured in a notch (not shown) or the like. It is also to be understood that, although the embodiment shown employs hooks 28 as the means for removably attaching the far ends 15 of the ropes 26 to the rim 16, other removable attachment means may be employed without departing from the principles of this invention. Further, it is to be recognized that the hooks or other fastening devices need not attach to the rim itself, but may attach to some other part of the swimming pool or some other separate anchoring means, at or outside the rim of the swimming pool. In addition, it is to be understood that, while the invention is described in the context of and adapted for an above-ground swimming pool, it could also be used with an in-ground swimming pool without departing from the principles of the invention.

Figure 3:
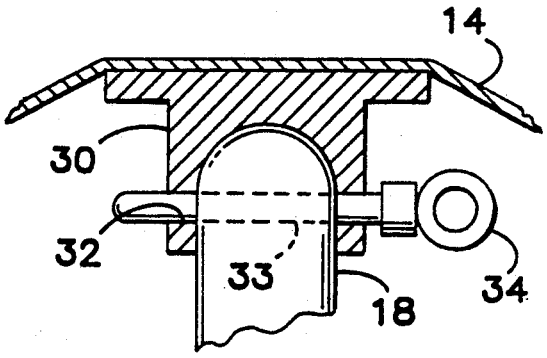
FIG. 3 is a partially cross-sectional, cut-away view of the top of the pool cover elevation device of FIG. 2, assembled, taken along line 3—3 thereof, including a cut-away portion of a pool cover.

Referring now to FIGS. 1, 2 and 3, the device 10 employs a receiving cup 30 which is adapted to be permanently affixed at a selected position to the underside of the pool cover 14. The receiving cup 30 is preferably affixed to the pool cover 14 by an adhesive, as is understood by those of ordinary skill in the art. Preferably, the cap is made of a molded, flexible plastic or other waterproof material so as not to unduly concentrate stress in the cover.

The receiving cup 30 provides a concave receptacle into which the top end of upper portion 18 may be removably seated. The respective surfaces of the receiving cup 30 and the top end of the upper pole portion 18 that are in contact with one another are rounded in order to conform generally to each other in a manner allowing the portion 18 to pivot when seated in the cup 30. In addition, the cup 30 and the top end of the pole 11 include attachment apertures 32 and 33, respectively, therein which may be aligned so that an attachment pin 34 may be removably inserted to secure the top end of the pole 11 in the cup 30.

As shown in FIG. 1, with the receiving cup 30 affixed to the pool cover 14, with the top end of the pole 11 seated in the receiving cup 30, and with the bottom end of the pole 11 suspended by the plurality of ropes 26 from the swimming pool rim 16, the pole 11 is disposed in a substantially upright orientation at a location inside the area enclosed by the rim 16. In that position, adjustment of the overall length of the pole 11 by the upper and lower portions 18, 20 result in the elevation of the pool cover 14 to a selected height above the rim 16 of the swimming pool 12.

Figure 5:
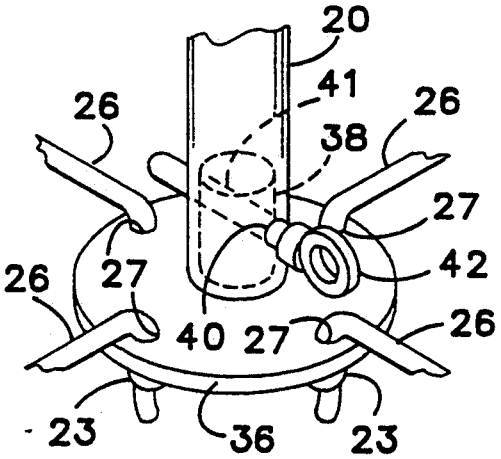
FIG. 5 is a perspective view of a portion of an alternative embodiment of the pool cover elevation device of the present invention, showing alternative means for attaching the bottom of a lower pole portion of the device to suspension ropes.

Referring now to FIG. 5, an alternative embodiment of the connection between the bottom end of the lower portion 20 and the ropes 26 is shown. In the alternative embodiment, the ropes 26 are connected to a disc 36 at substantially evenly-spaced intervals around the disc 36. The ropes may be attached by tying knots 23 at one end, as shown, or two ropes may be combined into one which passes through a hole 27 on one side of the disc and out a hole 27 on the other side of the disc, the rope being tied in a knot in between or into two knots on respective sides of the disc.

The disc 36 has an axial member 38 centrally disposed thereon which fits into an aperture in the bottom end of the lower portion 20. Axial member 38 and the bottom end of the lower portion 20 have apertures 40 and 41, respectively, therein that may be aligned so that a bottom pin 42 may be removably inserted to secure the axial member 38 in the aperture in the bottom end of the lower portion 20. When the axial member 38 is secured in the lower portion 20 and the ropes 26 are attached to the rim 16 of the swimming pool 12, the pole 11 is suspended from the rim 16 so as to allow the device 10 to elevate the pool cover 14. In the embodiment shown, it will be understood that, besides either a direct connection of the ropes 26 to the lower pole 20 or an indirect connection by means of the disc 36, other structures might be employed to provide the suspension function without departing from the principles of the invention.

The terms and expressions which have been employed in the foregoing specification are employed therein as terms of description and not of limitation, and there is no intention in the use of such terms and expressions of excluding equivalents of the features shown and described or portions thereof, it being recognized that the scope of the invention is defined and limited only by the claims which follow.

We claim:

1. A device for elevating a flexible pool cover above the rim of a swimming pool, comprising:

(a) elongate support means, having a top end and a bottom end, for supporting said pool cover;

(b) suspension means, connected to the bottom end of said support means and having means for connection at or outside the rim of said pool, for suspending said support means, in a substantially upright orientation at a location inside the rim of said pool; and (c) attachment means, adapted to be coupled to the top end of said support means and to apply upward force to said pool cover, for elevation of said pool cover above the rim of said pool.

2. The device of claim 1, wherein said support means comprises a substantially rigid pole.

3. The device of claim 2, wherein said pole is made of plastic.

4. The device of claim 2, wherein said pole is made of wood.

5. The device of claim 2, wherein said pole is made of water-resistant material.

6. The device of claim 1, wherein said support means comprises a support member of adjustable length.

7. The device of claim 6, wherein said support member comprises two elongate portions, one of which fits slidably within the other, and means for fixing the position of the one portion with respect to the other.

8. The device of claim 7, wherein each of said portions contains holes through which a pin can be removably inserted to fix the position of one portion with respect to the other portion.

9. The device of claim 1, wherein said suspension means comprises a plurality of tension elements having a near end and a far end, said tension elements being attached at the near end to the bottom of said support means and including means for removably attaching their respective far ends to structure disposed at or outside the rim of said pool.

10. The device of claim 9, wherein said tension elements comprise ropes.

11. The device of claim 9, wherein said tension elements comprise elastic cables.

12. The device of claim 9, wherein said tension elements include means for adjusting the length thereof.

13. The device of claim 9, wherein said means for removably attaching the far ends of said suspension means comprises a hook.

14. The device of claim 9 wherein said suspension means further comprises connection means for removably connecting said suspension means to said supporting means.

15. The device of claim 14, wherein said connection means comprises a disc to which the near ends of said tension elements are attached, an axial member centrally disposed on said disc for attaching said support means to said disc, said support means having an aperture for receiving said axial member, and means for securing said support means to said axial member.

16. The device of claim 1, wherein said attachment means comprises a receiving cup having an upper portion for placement against the underside of said pool cover and a lower portion into which the top end of said support means may be seated and removably secured.

17. The device of claim 16, wherein said lower portion of said receiving cup has a concave surface into which the top end of said support means may be seated and the top end of said support means has a convex surface that conforms in shape generally to the concave surface of said receiving cup so as to allow said support means to pivot therein.

18. The device of claim 16, wherein said cup and the top end of said support means include respective apertures therein which may be aligned for receiving an attachment pin and said attachment means includes an attachment pin for placement therein.

19. The device of claim 1, wherein said support means comprises a substantially rigid pole, said suspension means comprises a plurality of tension elements attached at one end to the bottom of said pole and having means at the opposite end thereof for releasably attaching said opposite ends to structure disposed at or outside the rim of said pool, and said attachment means comprises a cup having an upper portion for attachment to said pool cover and a lower portion for receiving the top end of said pole.

20. In a swimming pool having a flexible pool cover, a device for elevating said pool cover above the rim of said pool, comprising:

(a) elongate support means, having a top end and a bottom end, for supporting said pool cover;

(b) suspension means, connected to the bottom end of said support means and to structure at or outside the rim of said pool, for suspending said support means at a location inside the rim of said pool in a substantially upright orientation; and (c) attachment means, affixed in part at a selected position to said pool cover, for attaching said support means to said pool cover so as to elevate said pool cover above the rim of said pool.

* * * * *